US006755630B2

(12) United States Patent
Kim et al.

(10) Patent No.: US 6,755,630 B2
(45) Date of Patent: Jun. 29, 2004

(54) APPARATUS FOR COMPRESSING FLUID

(75) Inventors: Gui-gwon Kim, Suwon (KR); Sung-tae Lee, Gwangju (KR); Kyung-tae Jang, Anyang (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 58 days.

(21) Appl. No.: 10/140,143

(22) Filed: May 7, 2002

(65) Prior Publication Data

US 2003/0103854 A1 Jun. 5, 2003

(30) Foreign Application Priority Data

Dec. 3, 2001 (KR) ..... 2001-75756

(51) Int. Cl.[7] ..... F04B 39/10; F04B 7/04
(52) U.S. Cl. ..... 417/501; 417/520
(58) Field of Search ..... 222/388, 380, 222/381, 386, 386.5; 417/501, 510, 520, 540, 551, 569, 570, 417, 259, 523, 495, 545

(56) References Cited

U.S. PATENT DOCUMENTS 1,535,643 A * 4/1925 Astrom ..... 417/501
2,751,146 A * 6/1956 Moseley ..... 230/172
3,022,736 A * 2/1962 Bowen, Jr. ..... 103/37
6,152,710 A * 11/2000 Oh et al. ..... 417/570
6,190,143 B1 * 2/2001 Jacobsen et al. ..... 417/570

* cited by examiner

*Primary Examiner*—Justine R. Yu
*Assistant Examiner*—Han L Liu
(74) *Attorney, Agent, or Firm*—Ladas & Parry

(57) ABSTRACT

An apparatus for compressing fluid comprises a cylinder bore longitudinally penetrating a cylinder block a suction port penetrating to the cylinder bore, and a pair of slot-shaped fluid discharge having one opening at an end portion of the cylinder bore; a piston; a discharge valve assembly movably disposed at the cylinder bore to selectively open and close the fluid discharge ports of the cylinder block, the discharge valve assembly including a valve piston having a flange for limiting movement of the discharge valve assembly; a cylinder head defining a discharge chamber communicating with the fluid discharge ports, the cylinder head having a fluid discharge passage from the discharge chamber. The fluid suction port is selectively opened by the piston reciprocally moving in the cylinder bore to draw in fluid, which is discharged through the fluid discharge ports opened by the movement of the valve piston as the pressure of the fluid in the cylinder bore increases beyond a predetermined threshold. The compressed fluid is fully discharged, and clearance volume can be eliminated or minimized.

19 Claims, 8 Drawing Sheets

APPARATUS FOR COMPRESSING FLUID

BACKGROUND OF THE INVENTION

1. Field of the Invention

The present invention relates generally to a compressing apparatus, and more particularly, to an apparatus for compressing, pumping, and discharging fluid by using a reciprocal linear movement of a piston.

2. Description of the Related Art

One typical example of a conventional apparatus for compressing fluid is shown in FIGS. 1 and 2.

FIGS. 1 and 2 are views schematically showing in cross-section, the structure and operation of a conventional apparatus for compressing fluid. The reference numeral 10 indicates a cylinder block, 20 indicates a piston, 30 indicates a valve plate, and 40 indicates a cylinder head.

As shown in FIGS. 1 and 2, the cylinder block 10 has a cylinder bore 11 with a predetermined diameter penetrating thereof in a lengthwise or longitudinal direction. The piston 20 is disposed within the cylinder bore 11 of the cylinder block 10 in order to move reciprocally therein.

The valve plate 30 is disposed adjacent the cylinder block 10. The valve plate 30 has a fluid suction hole 31 and a fluid discharge hole 32 disposed therein. In addition, the valve plate 30 has a suction valve 33 (most clearly shown in phantom in FIG. 2) and a discharge valve 34 (most clearly shown in FIG. 1) disposed thereon for opening and closing the fluid suction hole 31 and the fluid discharge hole 32, respectively.

Furthermore, the cylinder head 40 is disposed at the cylinder block 10 at a side where the valve plate 30 is disposed, and has a fluid suction chamber 41 and a fluid discharge chamber 42 disposed thereon. The fluid suction chamber 41 and the fluid discharge chamber 42 are each associated with the fluid suction hole 31 and the fluid discharge hole 32, respectively, of the valve plate 30. Moreover, a fluid suction manifold 43 and a fluid discharge manifold 44, which communicate with the fluid suction chamber 41 and the fluid discharge chamber 42, respectively, are connected with the cylinder head 40.

In the conventional apparatus for compressing the fluid having the above structure, a fluid is drawn, compressed, and discharged by the piston 20 reciprocally moving within cylinder bore 11 by receiving power provided from a piston driving source (not shown). The piston 20 moves in the cylinder bore 11 of the cylinder block 10.

More specifically, when the piston 20 moves from a top dead point T (FIG. 1) of the cylinder bore 11 to a bottom dead point B (FIG. 2) of the cylinder bore 11, the suction valve 33 opens the suction hole 31 of the valve plate 30 as a result of a difference in pressure between the inside of the cylinder bore 11 and the inside of fluid suction chamber 41, as shown in FIG. 2. Therefore, the fluid is drawn into the inside of the cylinder bore 11 of the cylinder block 10 through the suction manifold 43, the suction chamber 41 of the cylinder head 40, and the suction hole 31 of the valve plate 30. The pressure in the discharge chamber 42 of the cylinder head 40 is higher than that of the inside of the cylinder bore 11, thus the discharge valve 34 is retained in a closed position (as shown in FIG. 2), thus closing off the discharge hole 32.

On the other hand, when the piston 20 moves from the bottom dead point B (FIG. 2) of the cylinder bore 11 to the top dead point T (FIG. 1) of the cylinder bore 11, then the fluid, drawn into the cylinder bore 11 during the piston downstroke, is gradually compressed. Finally, as shown in FIG. 1, when the piston 20 reaches the top dead point T, the pressure in the cylinder bore 11 becomes higher than that of the discharge chamber 42 of the cylinder head 40, thus the discharge valve 34 opens the discharge hole 32 of the valve plate 30. Accordingly, the compressed fluid is discharged through the discharge hole 32 of the valve plate 30, into the discharge chamber 42 of the cylinder head 40, and out through the discharge manifold 44. At this time, the pressure of the suction chamber 41 of the cylinder head 40 is lower than that of the cylinder bore 11, thus the suction valve 33 is retained in a closed position (as shown in FIG. 1), thus closing off the suction hole 32.

Furthermore, when the piston 20 moves again to the bottom dead point B, the suction hole 31 is opened by the suction valve 33, and the discharge hole 32 is closed by the discharge valve 34, thus causing fluid to be drawn from the suction chamber 41. After that, when the piston 20 moves again to the top dead point T, the drawn fluid is repeatedly compressed and discharged, in a continuously operating cycle.

However, in the conventional apparatus for compressing the fluid as described so far, the fluid compressed by the piston 20 is not fully discharged. Some of the compressed fluid is left in the discharge hole 32 of the valve plate 30, Therefore, while the fluid is being drawn, in other words, when the piston 20 moves from the top dead end point T to the bottom dead end point B, the remaining fluid, at a high pressure, is re-expanded as the piston 20 moves in its downstroke. Owing to the re-expanded high pressure fluid, in the beginning of the fluid drawing sequence, in other words, when the piston 20 moves to the bottom dead end point B, the pressure of the cylinder bore 11 is lower than that of the discharge chamber 42 of the cylinder head 40, but the pressure is higher than that of the suction chamber 41. Therefore, at the time when the piston 20 starts its downstroke, moving to the bottom dead end point B, suction does not immediately occur. Yet, after the pressure of the cylinder bore 11 becomes lower than that of the suction chamber 41, as the piston 20 fully moves to the bottom dead end point B, the suction valve 33 is opened and new fluid is drawn. Consequently, in the conventional apparatus for compressing the fluid, as the high pressure fluid remaining in the suction hole 32 creates a clearance volume of the cylinder bore 11 during every stroke cycle, the amount of the fluid drawn into cylinder bore 11 is decreased and results in a deterioration in efficiency.

Moreover, since the conventional apparatus for compressing the fluid must employ the suction valve 33 and the discharge valve 34 having a complex structure for opening the suction hole 31 and the discharge hole 32, assembly of the compressor apparatus is complicated. Furthermore, it does not lend itself to a good production method and also the construction results in high production costs.

SUMMARY OF THE INVENTION

An object of the present invention is to provide an apparatus for compressing fluid capable of improving efficiency by removing the clearance volume found in a conventional cylinder bore as compressed fluid is fully discharged.

Another object of the present invention is to provide an apparatus for compressing fluid capable of reducing the production cost and improving the ease of assembly and the manufacturing productivity as the compressing apparatus is constructed, by providing a piston that opens and closes a fluid suction port without having a separate suction valve device and by providing a discharge valve assembly having a simple structure.

The above objects are accomplished by providing an apparatus for compressing a fluid comprising: a cylinder block including a cylinder bore with a predetermined diameter penetrating the cylinder block in a lengthwise direction, at least one fluid suction port penetrating in an intersecting direction with the cylinder bore, and at least a pair of fluid discharge ports, each discharge port having a slot shape with one opening formed at an end portion of the cylinder bore; a piston for reciprocally moving in the cylinder bore of the cylinder block; a discharge valve assembly movably disposed at the cylinder bore in order to selectively open and close the fluid discharge ports of the cylinder block, the discharge valve assembly including a valve piston having a flange for limiting a movement of the discharge valve assembly; and a cylinder head for forming a discharge chamber communicated with the fluid discharge ports of the cylinder block by being connected with the cylinder block, and the cylinder head having a fluid discharge passage of the discharge chamber.

According to the above described apparatus for compressing fluid, the fluid is drawn as the fluid suction port is selectively opened and closed by the piston reciprocally moving in the cylinder bore of the cylinder block. In addition, the fluid is discharged through the fluid discharge port opened by the valve piston moved by the increased fluid pressure in the cylinder bore. Therefore, as the conventional suction valve with a complex structure is removed, and the structure of the discharge valve becomes simpler, assembly and productivity of the compressing apparatus will be improved. Moreover, the production cost will be also reduced remarkably. Furthermore, since the high pressure fluid compressed in the cylinder bore is fully discharged through the discharge port, the clearance volume generated due to remaining fluid in the cylinder bore can be eliminated, and thus compressing efficiency will be improved.

According to the preferred embodiment of the present invention, in the apparatus for compressing fluid, the position of the top dead endpoint of the piston arranged at a point slightly past an end portion of the cylinder bore, and accordingly, any fluid compressed in the cylinder bore is fully discharged as the piston and the valve piston come into contact with each other at the top dead end point.

Furthermore, the fluid suction port is disposed immediately before a bottom dead end point, that is, the most retreated position of the piston, and accordingly, the fluid is promptly drawn by the vacuum developed in the cylinder bore as the fluid suction port is suddenly opened when the piston reaches the bottom dead end point.

The discharge valve assembly preferably comprises: a valve piston for moving in the cylinder bore, the valve piston having a flange for limiting the movement of the valve piston by being in contact with an end wall of the cylinder bore, the flange having a first boss formed roughly in a center of a flange; a support plate disposed in the cylinder head being distanced for a predetermined space with the valve piston, the support plate has a second boss formed therein corresponding to the first boss and a plurality of fluid passages radially formed centering the second boss; and an resilient member disposed between the valve piston and the support plate, the resilient member for elastically supporting the valve piston to be moved in a direction that the valve piston closes the fluid discharge ports.

In addition, the cylinder block can be formed to have either a circular appearance or a square appearance.

The fluid suction ports can be disposed at two opposite sides of the cylinder block, or more than two fluid suction ports can be disposed extending through the cylinder block at predetermined intervals.

The fluid suction ports can be tapered or formed as a two layered port having one port of greater diameter and a second port of smaller diameter, or alternatively, a port compounded with these two types.

Moreover, the fluid suction ports can be formed to have a more extended suction area by cutting away a portion of at least one side of the cylinder block. In this case, as the area of the fluid suction ports becomes greater, the fluid can be drawn into the cylinder bore 11 more efficiently.

BRIEF DESCRIPTION OF THE DRAWINGS

The object and the feature of the present invention will be more apparent by describing the preferred embodiments of the present invention by referring to the appended drawings, in which.

DETAILED DESCRIPTION OF THE PREFERRED EMBODIMENTS

Hereinbelow, the preferred embodiments of the present invention will be described in greater detail by referring to the appended drawings.

Figure 1:
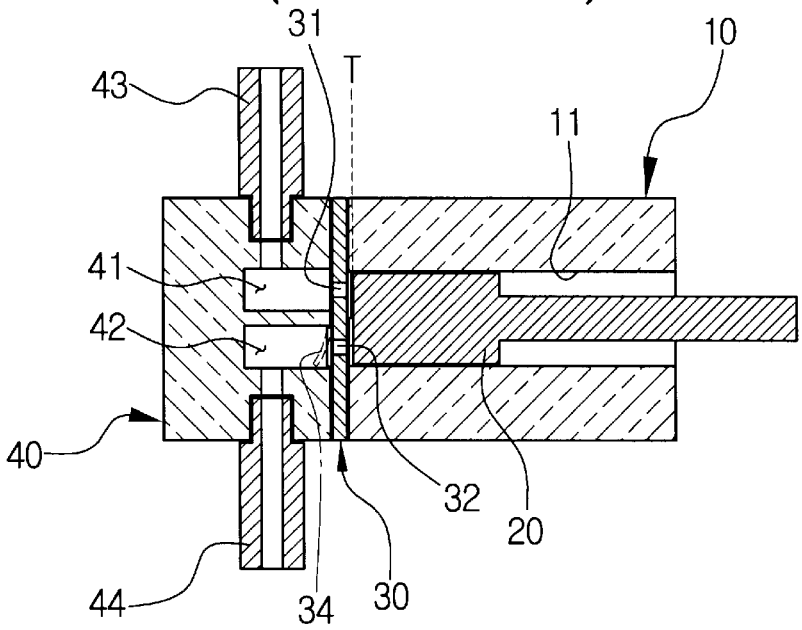
FIG. 1 (PRIOR ART)
FIGS. 1 and 2 are cross-sectional views schematically showing a structure and an operation of a conventional apparatus for compressing fluid.
Figure 2:
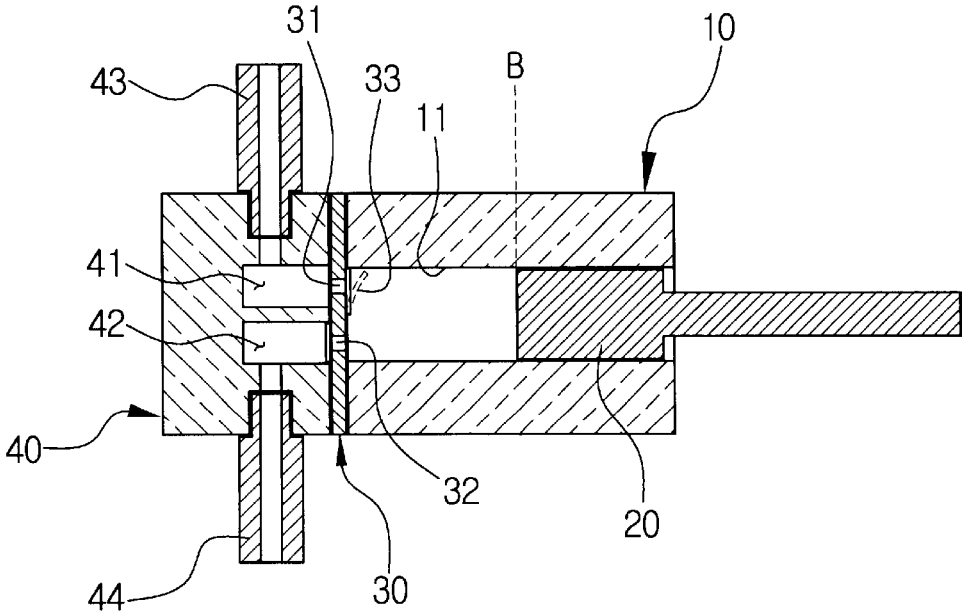
FIG. 2 (PRIOR ART)
Figure 3:
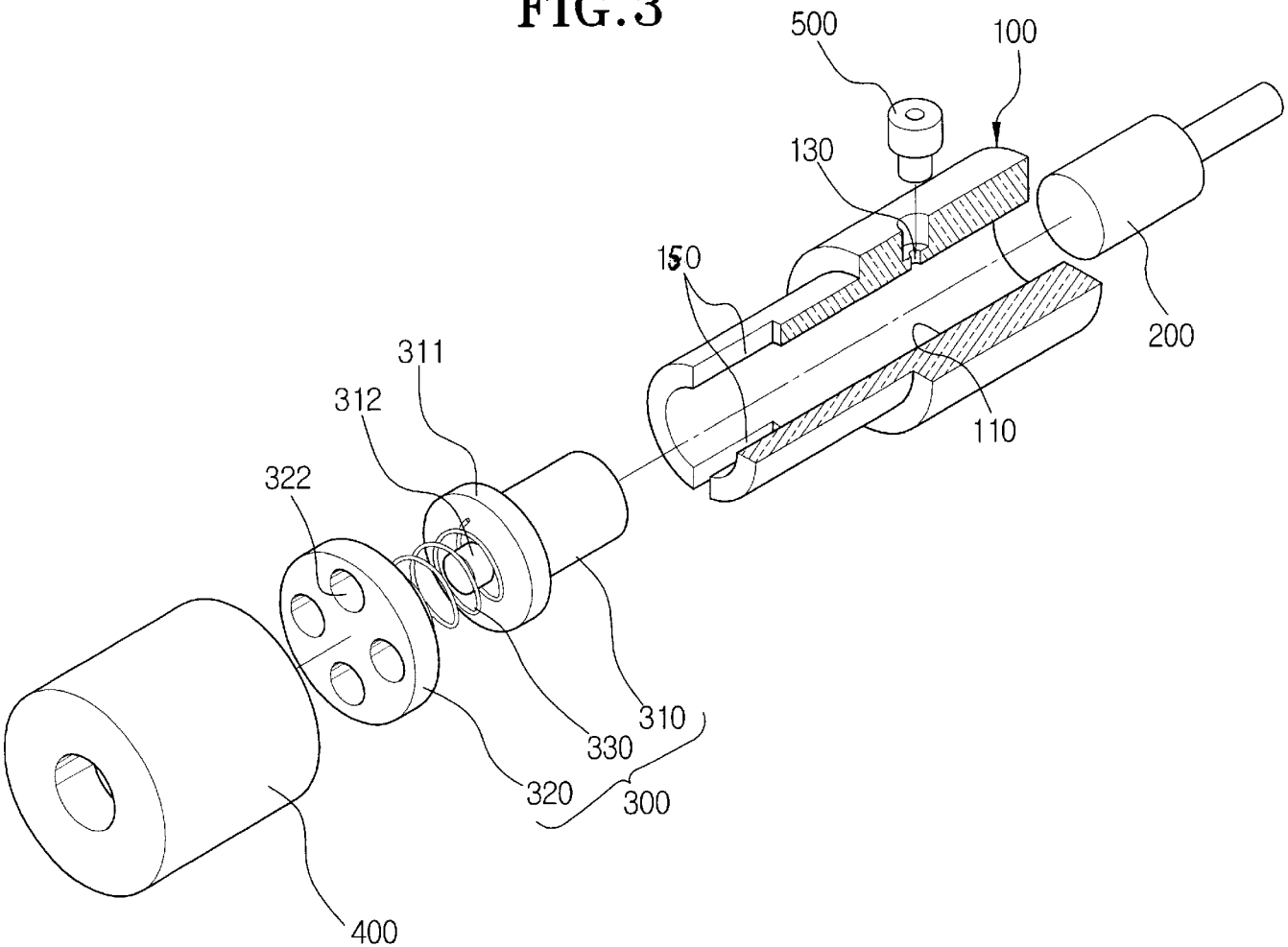
FIG. 3 is an exploded perspective cutaway view showing an apparatus for compressing fluid according to the first preferred embodiment of the present invention.
Figure 4:
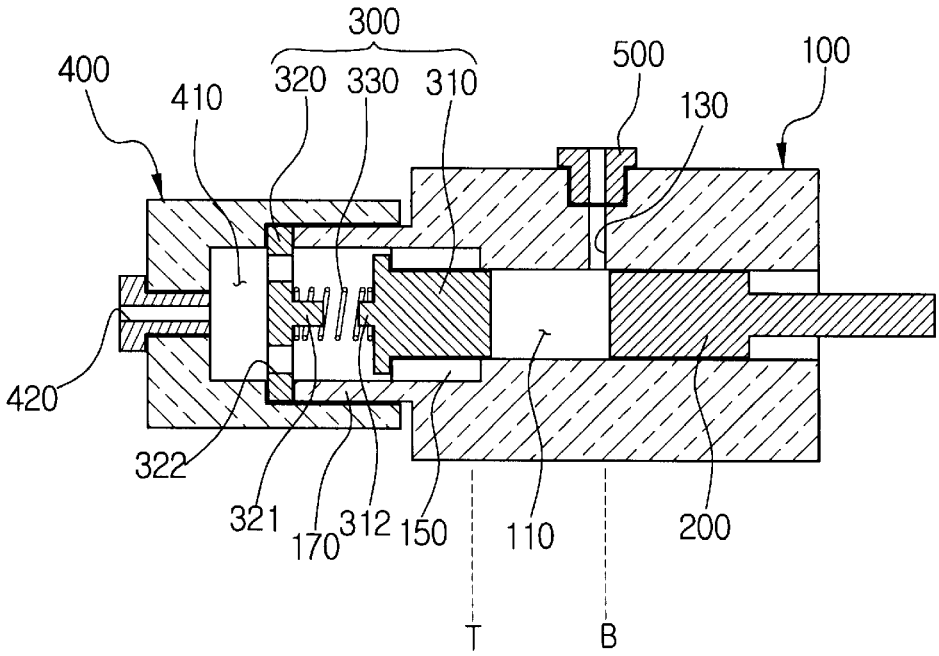
FIGS. 4 through 6 are cross-sectional views describing a structure and an operation of the apparatus for compressing the fluid according to the first preferred embodiment of the present invention shown in FIG. 3.
Figure 5:
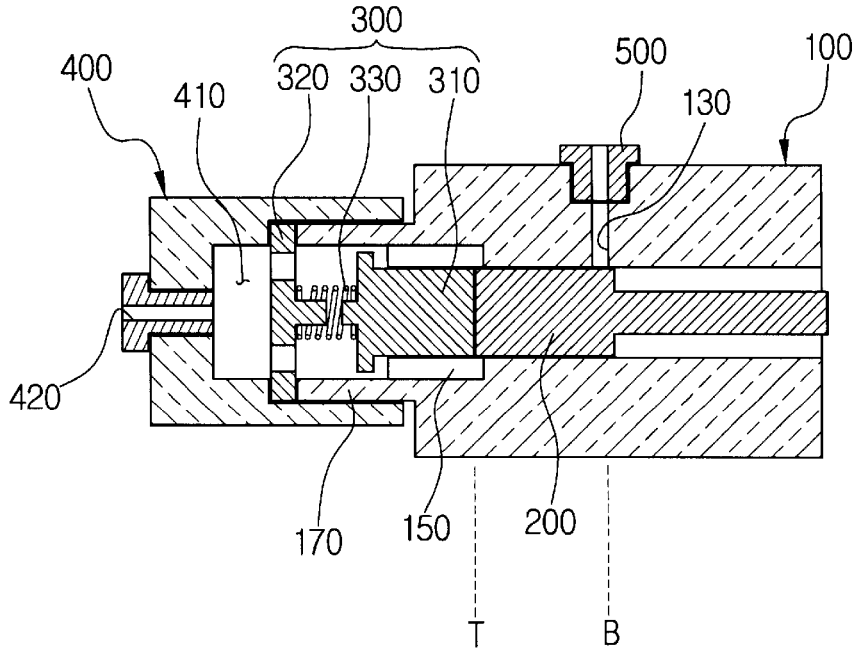
Figure 6:
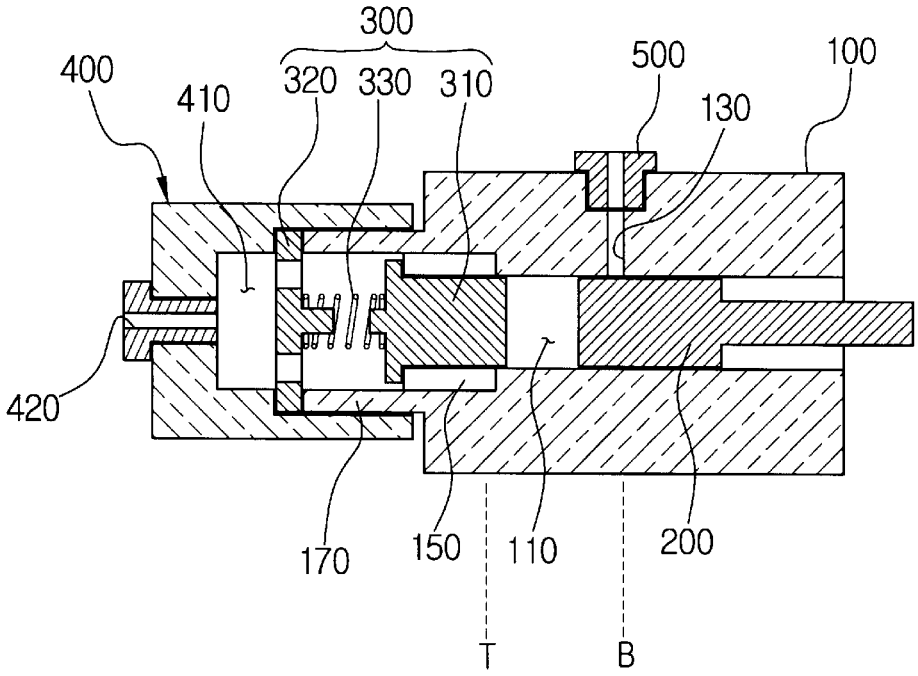

FIG. 3 is an exploded perspective cutaway view showing an apparatus for compressing fluid according to the first preferred embodiment of the present invention. FIGS. 4 through 6 are cross-sectional views describing the structure and operation of the apparatus for compressing the fluid according to the first preferred embodiment of the present invention shown in FIG. 3.

As shown in FIGS. 3 through 6, the apparatus for compressing the fluid of the present invention comprises a cylinder block 100, a piston 200, a discharge valve assembly 300 and a cylinder head 400.

The cylinder block 100 comprises a cylinder bore 110 having a predetermined diameter and penetrating through the cylinder block 100 in a lengthwise direction, at least one fluid suction port 130 penetrating at a right angle relative to the cylinder bore 110, and at least one pair of fluid discharge ports 150 formed as a slot-shape having one opening at both end portions of the cylinder bore 110. Moreover, the cylinder block 100 has a connection boss 170 for connecting the cylinder head 400 thereto.

Figure 7A:
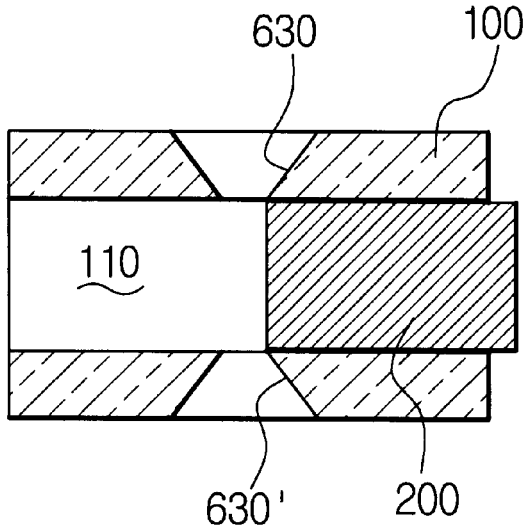
FIGS. 7A through 7G are views showing other various preferred embodiments of a cylinder block and a fluid suction hole of the apparatus for compressing the fluid according to the present invention.
Figure 7B:
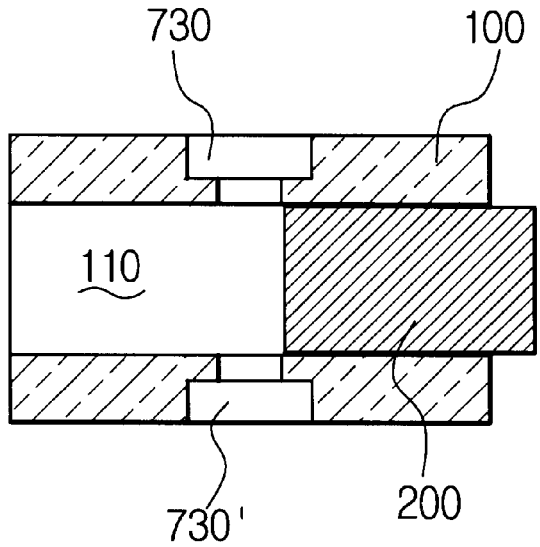
Figure 7C:
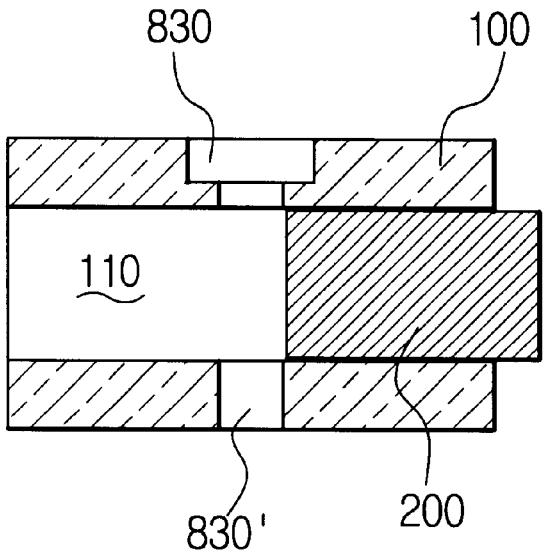
Figure 7D:
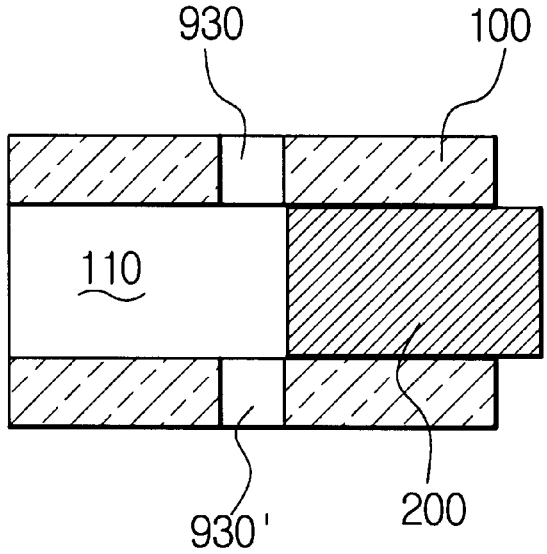
Figure 7E:
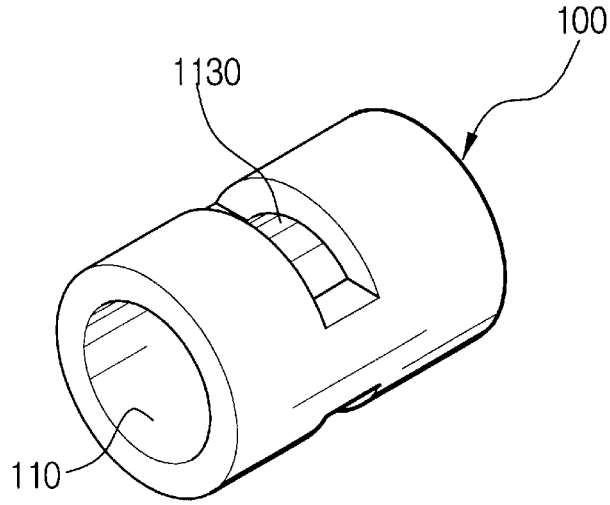
Figure 7F:
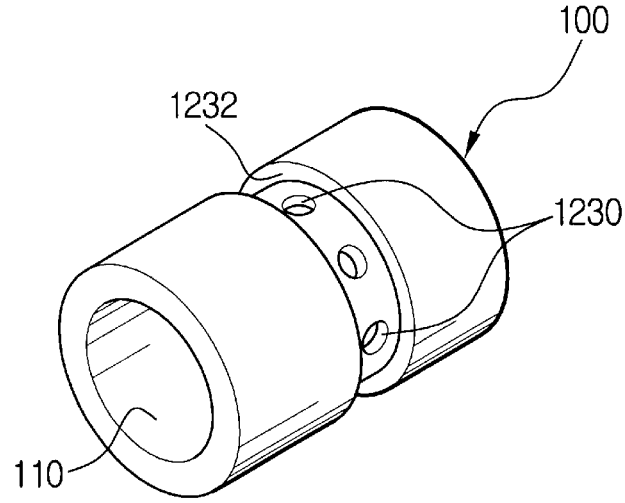
Figure 7G:
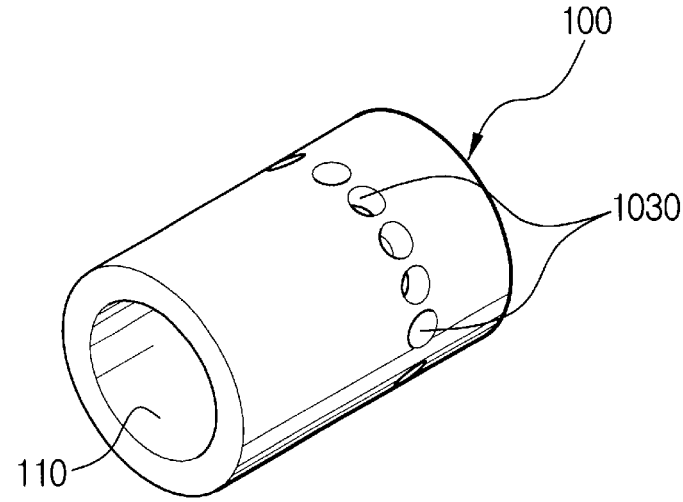
Figure 8:
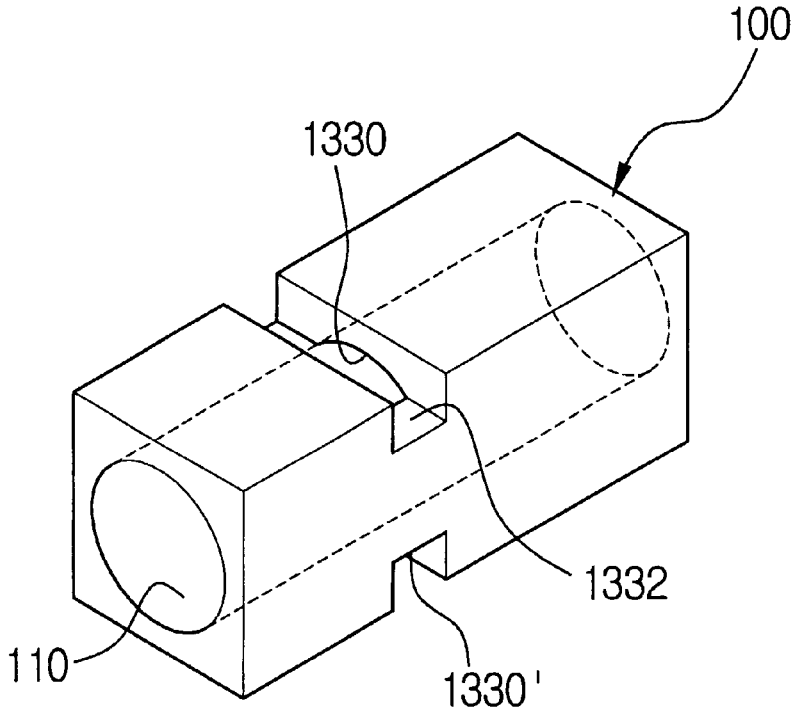
FIG. 8 is a perspective view showing yet another preferred embodiment of the cylinder block and the fluid suction hole of the apparatus for compressing the fluid according to the present invention.

The cylinder block 100 can be formed to have an appearance of a circular-shape as shown in FIGS. 7A through 7G, or a square type as shown in FIG. 8. Theoretically, the cylinder block 100 can be formed in any of a number of shapes. Therefore, the appearance of the cylinder block 100 is not to be considered as being defined by the preferred embodiments of the present invention described below.

Furthermore, in the preferred embodiment, the fluid suction port 130 is shown intersecting the cylinder bore 110 at a right angle, but this invention is not limited to the examples shown. In other words, if it is desirable for the flow of the fluid or the structure, the fluid suction port 130 can be formed being sloped at a predetermined angle (including an obtuse angle or an acute angle) in relation to the cylinder bore 110.

The piston 200 is disposed to reciprocally move within the cylinder bore 110 of the cylinder block 100, and draws and compresses fluid by receiving power from a separate driving source (not shown) causing it to reciprocally move in the cylinder bore 110. It is preferable that the piston 200 has a hollow core to decrease its own load. For the same reason, the piston 200 may be made of aluminum alloy.

The discharge valve assembly 300 has a valve piston 310 movably disposed at the cylinder bore 110 in order to selectively open and close the fluid discharge port 150 (FIGS. 4 and 5) of the cylinder block 100.

The valve piston 310 is a circular body having almost the same diameter with the inner diameter of the cylinder bore 110, and a flange 311 is formed at one longitudinal end of the valve piston 310 in order to limit the flow of the fluid around the valve piston 310 due to contact with a cylinder wall defining an end portion of the cylinder bore 110. Accordingly, the valve piston 310 opens and closes the fluid discharge port 150 by moving during an upstroke without fully extending into the cylinder bore 110. A first boss 312 is formed roughly in the center of the flange 311.

The discharge valve assembly 300 further comprises a support plate 320 disposed within the cylinder head 400 at a predetermined distance from the valve piston 310, and a resilient member 330 disposed between the valve piston 310 and the support plate 320 in order to flexibly support the valve piston 310 to move in the direction of closing the fluid discharge port 150. Accordingly, the valve piston 310 closes the fluid discharge port 150 by being retained in an initial state by the resilient member 330 during the fluid drawing downstroke step in which there is no pressure in the cylinder bore 110. When the pressure to the cylinder bore 110 is high, in other words, in the fluid compressing upstroke, the valve piston 310 opens the fluid discharge port 150 and allows the fluid to be discharged as the valve piston 310 overcomes the resistance of the resilient member 330 and is pushed by the high pressure of the fluid developed in the cylinder bore 110. The support plate 320 has a second boss 321 formed roughly in the front center thereof, corresponding and opposed to the first boss 312 of the valve piston 310. At least three fluid passages 322 (FIG. 3) are radially formed being equidistant and separated by a predetermined length from the outer edge of the second boss 321.

As shown in FIGS. 4 and 5, the support plate 320 can be installed at an end of the connection boss 170 of the cylinder block 100, since the cylinder head 400 is shown being connected with the connection boss 170, but the connection method is not limited by the described example. Alternatively, the support plate 320 can be installed by another method, for example, by welding. In the meantime, a compressed coil spring can be used as the resilient member 330, and in this case, the compressed coil spring is installed by being supported by the first and the second bosses 312, 321, respectively formed at the valve piston 310 and the support plate 320. Moreover, any kind of resilient member may be used for the resilient member 330, including the disclosed compressed coil spring or a plate spring.

The cylinder head 400 is connected to the connection boss 170 of the cylinder block 100, and a discharge chamber 410, which communicates with the fluid discharge port 150, is formed in the cylinder head 400. In addition, a fluid discharge passage 420, which communicates with the discharge chamber 410, is formed at the cylinder head 400. The structure of the cylinder head 400, as installed, is also not limited to one type, but the cylinder head 400 may be installed using screws, as in the preferred embodiment of the present invention.

In FIGS. 3 through 6, a fluid suction manifold 500 extends into the cylinder block 100 at the suction port 130.

According to the apparatus for compressing the fluid having the above-described structure, the operation proceeds as follows. The fluid is rapidly drawn by the vacuum developed in the cylinder bore 110 as the fluid suction port 130 is selectively opened by the piston 200 reciprocally moving in the cylinder bore 110, and the fluid is fully discharged as the fluid discharge port 150 is opened when the valve piston 310 is pushed by the high pressure fluid developed in at the cylinder bore 110.

The structure achieves a remarkable effect by use of the present invention as is shown in FIGS. 4 through 6. Referring to FIGS. 4 through 6, the position of a top dead end point T of the piston 200 is set up being slightly past the end portion of the cylinder bore 110. Accordingly, the fluid compressed in the cylinder bore 110 can be fully discharged as the piston 200 and the valve piston 310 contact each other at the top dead end point T. In other words, the high-pressure fluid, which is left without being discharged in the conventional compressor, is not retained in the cylinder bore 110 in the present invention, thus the clearance volume can be effectively eliminated.

The second structure of the present invention is that the fluid suction port 130 is disposed right before a bottom dead end point B of the piston 200. A separate suction valve device for opening and closing the fluid suction port 130 is not necessary, and thus not provided, since the piston 200 itself selectively opens and closes the fluid suction port 130 by reciprocally moving in the cylinder bore 110. Therefore, when the piston 200 reaches the bottom dead end point B, the fluid suction port 130 is instantly opened and the fluid is promptly drawn by the vacuum suction force of the cylinder bore 110. In addition, since a separate suction valve device having a complex structure as in the conventional compressor is unnecessary, the structure of the compressor can be simpler. Moreover, as the fluid is rapidly drawn and discharged, the cooling effect of the cylinder block can be somewhat enhanced.

Meanwhile, during operation in the apparatus for compressing the fluid according to the present invention, the fluid is drawn as the fluid suction port 130 is suddenly opened by the movement of the piston 200 to clear the suction port 130. However, when the fluid is drawn through the fluid suction port 130, the time of clearance is short due to the position of suction port 130. Thus the amount of the drawn fluid may be less than desirable. Considering this fact, as shown in FIGS. 7A through 7G, in the present invention at least two fluid suction ports (630, 630', 730, 730', 830, 830', 930, 930', 1130, 1230, and 1030 respectively) are formed at the position corresponding to the cylinder block 100 so that more fluid can be promptly drawn into the cylinder bore 110, as shown.

According to the other illustrated examples, the fluid suction ports 630, 630' can be: tapered, the parts being gradually reduced from an outside to an inside of the cylinder block 100 as shown in FIG. 7A or double layered ports 730, 730', having a greater diameter portion and a smaller diameter portion, as shown in FIG. 7B, may be used. In addition, one of the suction ports 830, can be double layered having a greater diameter and a smaller diameter, and the other suction port 830' can be formed as a hole having a predetermined diameter as shown in FIG. 7C. Alternatively, two suction ports 930, 930' can be formed as a circular hole having predetermined diameters as shown in FIG. 7D.

Furthermore, a plurality of fluid suction ports 1030 can be formed at an entire outer circumference of the cylinder block 100 in order to secure a greater area for drawing the fluid, as shown in FIG. 7G. Additionally, a sectional part of the cylinder block 100 can be cut in order to form one or more grooves 1130 that communicate with the cylinder bore 110, as shown in FIG. 7E.

In the example shown in FIG. 7F, a cut portion forms a circumferential groove 1232 having a predetermined width and depth along the outer circumference of the cylinder block 100, and a plurality of fluid suction ports 830 are formed radially at predetermined equidistant intervals extending from the cut portion groove 1232 into the cylinder bore 110.

FIG. 8 illustrated another preferred embodiment of the present invention. As shown in FIG. 8, the cylinder block 100 is square-shaped. A cutaway portion forms a groove 1332, which communicates with the cylinder bore 110 extending through the cylinder block 100 and may be formed at one side or two sides of the square-shaped cylinder block 100. The fluid suction ports 1330, 1330' are formed at the intersection of the groove 1332 and cylinder bore 110. In this case, the area of the fluid suction port can be broadened, thus the fluid can be more easily drawn into the cylinder bore 110.

Hereinbelow, the operation of the apparatus for compressing the fluid according to the present invention having the above structures will be described referring to FIGS. 4 through 6. The structure shown in FIGS. 4–6 is exemplary, and the operation is applicable to the other above-described embodiments.

FIG. 4 shows that the piston 200 is completely moved to the bottom dead end point B at the cylinder bore 110. As the piston 200 is moved to reach the bottom dead end point B, the fluid suction port 130, which has been closed by the piston 200 is opened so that the fluid can be drawn into the cylinder bore 110 through the fluid suction port 130. When the piston 200 starts to move from the top dead end point T to the bottom dead end point B, the fluid discharge port 150 of the cylinder bore 110 is closed off by the valve piston 310, and the piston 200 is forced to move to the bottom dead end point B by an external driving source (not shown) during the cycle interval in which the fluid suction port 130 is also closed off by the piston 200. Therefore, the inside of the cylinder bore 110 develops a negative pressure or a vacuum. As the piston 200 further moves to the bottom dead point B, the negative pressure increases. Finally, when the piston 200 opens the fluid suction port 130, previously closed by the piston 200, as the piston 200 reaches to the bottom dead end point B, the fluid is rapidly drawn through the fluid suction port 130.

When the fluid is completely drawn, the piston 200 starts to compress the drawn fluid by moving to the top dead end point T from the bottom dead end point B. At this time, the fluid suction port 130 is closed off by the movement of the piston 200, and the valve piston 310 closes the fluid discharge port 150 as the valve piston 310 maintains the initial state by the pressure of the resilient member 330 and the discharge chamber 410 disposed outside thereof. Therefore, since the piston 200 is forced to move to the top dead end point T by the external driving source (not shown), the fluid therein is slowly compressed.

FIG. 5 shows the state in which the piston 200 is completely moved to the top dead end point T. As the piston 200 further moves to the top dead end point T, the fluid is compressed to a greater degree. When the piston 200 moves to a predetermined position, a balance between the pressure of the fluid and the resistive force of the resilient member 330 resiliently supporting the valve piston 310 is upset, that is, when the pressure of the fluid becomes greater than the resistive force of the resilient member). Thus, the valve piston 310 is pushed out and the fluid discharge port 150 is opened. Finally, the compressed high-pressure fluid is discharged to the discharge chamber 410. After that, the piston 200 still moves to the top dead end point T so that the fluid in the cylinder bore 110 can be fully discharged. During the above process, the piston 200 and the valve piston 310 come into contact with each other. The contact occurs at almost the same time as the fluid found between the piston 200 and the valve piston 310 is discharged, thus the piston 200 and the valve piston 310 can contact each other without causing any damage because of the buffer of the high-pressure fluid therebetween. As described above, the piston 200 moves to the top dead end point T disposed at a point past the end portion of the cylinder bore 110, thus there is no compressed fluid left in the cylinder bore 110 and the clearance volume becomes zero.

FIG. 6 shows the process that the piston 200, which has finished the compressing after moving to the top dead end point T, draws the fluid flowing to the bottom dead end point B. As shown in FIG. 6, the piston 200 moves to the bottom dead end point B. Here, the valve piston 310 closes off the fluid discharge port 150 by being returned to the initial position by the force of the resilient member 330 and the piston 200 closes the fluid suction port 130 at the moment when the piston 200 moves from the top dead end point T to the bottom dead point B. As the piston 200 moves to the bottom dead end point B, the vacuum is obtained in the cylinder bore 110. As the downstroke portion of the cycle progresses, the piston 200 reaches the bottom dead point B, as is shown in FIG. 4. Then, the fluid suction port 130 is suddenly opened, and the fluid is promptly drawn into the cylinder bore 110 through the fluid suction port 130 by the vacuum force in the cylinder bore 110. After that, the cycle of drawing and compressing described above is again performed. The fluid is drawn, compressed, and discharged by continuously repeating the above process.

In the meantime, the apparatus for drawing, compressing and discharging the fluid, especially a gas, has been shown and described. However, someone skilled in the art will know that the present invention can be applied to an apparatus for pumping a liquid, for example a pump.

As described according to the present invention, the compressed high-pressure fluid does not remain in the cylinder bore. Thus, the clearance volume of the conventional compressor, which is generated due to the re-expansion of the previously remaining fluid, can be eliminated. Therefore, the compressing efficiency can be increased, and owing to the fact, when a compressor having the structure of the present invention is applied to a freezing cycle of a refrigerator or an air cleaner, freezing and cooling can be remarkably improved.

Moreover, according to the present invention, since the suction valve having a complex structure is omitted and the discharge valve is manufactured having a simple structure, the entire structure of the compressor becomes simpler and the elements of the compressor can be more easily and automatically assembled. Therefore, the production cost will be reduced.

In addition, according to the present invention, the conventional suction valve is omitted and the operation of the discharge valve is improved. Therefore, a compressor according to the present invention may be driven more quietly, since there is no noise generated due to valve contact.

Consequently, according to the present invention, a compressor or a pump having a high compression ratio, reliability, and structure can be provided. Also, the assembly of the compressor or a pump is easy and can lower production costs.

So far, the preferred embodiments of the present invention have been illustrated and described. However, the present invention is not limited to the preferred embodiments described here, and someone skilled in the art can modify the present invention without distorting the point of the present invention as claimed below.

What is claimed is:

1. An apparatus for compressing a fluid comprising:

a cylinder block including a cylinder bore with a predetermined diameter penetrating the cylinder block in a lengthwise direction, at least one fluid suction port penetrating in a direction intersecting with the cylinder bore, and at least a pair of fluid discharge ports, each fluid discharge port having a slot shape with one opening formed at an end portion of the cylinder bore;

a piston for reciprocally moving in the cylinder bore of the cylinder block;

a discharge valve assembly movably disposed at the cylinder bore in order to selectively open and close the fluid discharge ports of the cylinder block, the discharge valve assembly including a valve piston having a flange for limiting movement of the discharge valve assembly; and a cylinder head defining a discharge chamber communicating with the fluid discharge ports of the cylinder block by being connected with the cylinder block, wherein the fluid is drawn into the cylinder bore as the fluid suction port is selectively opened by the piston reciprocally moving in the cylinder bore and is discharged through the fluid discharge ports, the fluid discharge ports being opened by the movement of the valve piston as the pressure of the fluid in the cylinder bore reaches a predetermined amount.

2. The apparatus of claim 1, wherein a position of a top dead end point of the piston is disposed at a point slightly past an end portion of the cylinder bore so that fluid compressed in the cylinder bore is fully discharged as the valve and the piston are contacted with each other at the top dead end point.

3. The apparatus of claim 1, wherein the fluid suction port is disposed immediately before a bottom dead end point defined by the most retracted position of the piston so that retraction of the piston provides fluid communication between at least one fluid suction port and the cylinder bore and the fluid is drawn into the bore by the vacuum developed in the cylinder bore as the fluid suction port is suddenly opened when the piston reaches the bottom dead end point.

4. The apparatus of claim 3, wherein the profile of the cylinder block has a square-shape.

5. The apparatus of claim 4, wherein the fluid suction ports have a more extended suction area by a lateral cut extending through at least one side of the cylinder block.

6. The apparatus of claim 5, wherein at least two fluid suction ports are disposed at opposite sides of the cylinder block.

7. The apparatus of claim 3, wherein the profile of the cylinder block has a circular-shape.

8. The apparatus of claim 7, wherein at least two fluid suction ports are disposed at positions of the cylinder block opposite from each other.

9. The apparatus of claim 8, wherein the fluid suction ports are tapered.

10. The apparatus of claim 8, wherein the fluid suction ports are double layered, a first portion having a greater diameter and a second portion having a smaller diameter.

11. The apparatus of claim 8, wherein one of the suction ports is a double layered port having a greater diameter portion and a smaller diameter portion, and the other is a tapered port.

12. The apparatus of claim 7, wherein the plurality of fluid suction ports are disposed at an outer circumference of the cylinder block separated from each other by predetermined intervals.

13. The apparatus of claim 12, wherein the plurality of suction ports comprises holes having predetermined diameters.

14. The apparatus of claim 7 wherein a cut portion having a predetermined width and depth is disposed adjacent at least one of the fluid suction ports at the outer circumference of the cylinder block, and the plurality of suction ports, comprising holes having predetermined diameters, are disposed at the cut portion separated from each other by predetermined intervals.

15. The apparatus of claim 7, wherein the fluid suction ports have a more extended suction area by a lateral cut extending through one part of the cylinder block.

16. The apparatus of claim 15, wherein at least two fluid suction ports are disposed in an opposing relation to each other at opposite radial sides of the cylinder block.

17. An apparatus for compressing a fluid comprising:

a cylinder block including a cylinder bore with a predetermined diameter penetrating the cylinder block in a lengthwise direction, at least one fluid suction port penetrating in a direction intersecting with the cylinder bore, and at least a pair of fluid discharge ports, each fluid discharge port having a slot shape with one opening formed at an end portion of the cylinder bore;

a piston for reciprocally moving in the cylinder bore of the cylinder block;

a discharge valve assembly movably disposed at the cylinder bore in order to selectively open and close the fluid discharge ports of the cylinder block, the discharge valve assembly including a valve piston having a flange for limiting movement of the discharge valve assembly; and a cylinder head for forming a discharge chamber communicating with the fluid discharge ports of the cylinder block by being connected with the cylinder block, wherein the fluid is drawn as the fluid suction port is selectively opened by the piston reciprocally moving in the cylinder bore and discharged through the fluid discharge ports, the fluid discharge ports being opened by the movement of the valve piston as the pressure of the fluid in the cylinder bore reaches a predetermined amount, wherein the discharge valve assembly comprises:

a valve piston, at least a portion of which moves within the cylinder bore, the valve piston having a flange for limiting the movement of the valve piston by coming into contact with an end wall of the cylinder bore, the flange having a first boss formed roughly in the center of the flange;

a support plate disposed in the cylinder head being separated by a predetermined space from the valve piston, the support plate having a second boss formed therein corresponding to the first boss and a plurality of fluid passages formed in a radial pattern around and adjacent the center of the second boss; and a resilient member disposed between the valve piston and the support plate, the resilient member elastically supporting and urging the valve piston to be moved in a direction so that the valve piston closes off the fluid discharge ports.

18. The apparatus of claim 17, wherein the valve piston is hollow.

19. The apparatus of claim 17, wherein the resilient member comprises a compressed coil spring.

* * * * *